United States Patent [19]

Littles

[11] Patent Number: 4,777,570

[45] Date of Patent: Oct. 11, 1988

[54] ILLUMINATED DOORKNOB LOCK

[76] Inventor: Glen Littles, 1012 S.Beltline Rd., Mesquite, Tex. 75149

[21] Appl. No.: 10,984

[22] Filed: Feb. 5, 1987

[51] Int. Cl.[4] ..... E05B 17/10

[52] U.S. Cl. ..... 362/100; 70/431

[58] Field of Search ..... 362/100, 253; 315/84; 200/61.62, 61.64; 70/211, 431

[56] References Cited

U.S. PATENT DOCUMENTS

| | | | |
|---|---|---|---|
| 893,214 | 7/1908 | Williams et al. | 362/100 |
| 941,576 | 11/1909 | Hardin et al. | 362/100 |
| 2,676,244 | 4/1954 | Dittman | 362/100 |
| 2,709,745 | 5/1955 | Sundt | 362/100 |
| 3,719,821 | 3/1973 | Foreman | 362/100 |
| 3,955,075 | 5/1976 | Susedik | 362/100 |
| 4,310,873 | 11/1982 | Bean | 362/100 |

*Primary Examiner*—Ira S. Lazarus
*Assistant Examiner*—D. M. Cox
*Attorney, Agent, or Firm*—Glaser, Griggs & Schwartz

[57] ABSTRACT

For an entry door, a doorknob lock set includes an elongated stem which extends through a transverse opening in the door and is rotatable about its longitudinal axis to actuate the door latch. Doorknobs are provided at both ends of the stem to rotate the stem; and the stem includes a key lock mechanism including a key slot at the outer end of the stem. To illuminate the key lock slot, the outer doorknob is replaced by a knob fabricated from a translucent material. The translucent knob is provided with a central bore to receive the outer end of the stem; and the knob is mounted on the stem to frame the key slot. The knob is provided with at least one cavity opening from the inner face of the knob and extending toward the outer face. An illuminating device such as an incandescent bulb is placed in that cavity. Electric conductors connected to the illuminating device extend out of the cavity for connection to a source of electric energy. The source of electric energy may be a battery pack, with or without switch, mounted on the door adjacent to the exterior doorknob, or may be connected to wiring of the building structure such as the doorbell circuit.

4 Claims, 1 Drawing Sheet

ILLUMINATED DOORKNOB LOCK

BACKGROUND AND SUMMARY OF THE INVENTION

This invention relates to a door lock set having a ket slot within the doorknob, wherein the key lock slot is illuminated from within the doorknob.

It is frequently a cause for some aggravation when one approaches a building entry door in the dark and has difficulty locating the key slot to unlock the entry door. More than aggravation, it may be a source of considerable discomfort where the entry door is not protected from the elements and the weather is inclement.

On occasions, it may be desirable to be able to enter a building quickly at night from a safety standpoint. Difficulty in one's ability to insert the key in the lock is increased when one is under some apprehension for his or her safety, for example.

A principal object of this invention is to provide a simple and effective means for illuminating a doorknob key slot, to facilitate the insertion of the key therein.

Another object of this invention is provide such doorknob illuminating means wherein the illumination may be provided either continuously or selectively.

A further object of this invention is to provide such doorknob illuminating means which may be used with various types of door lock sets, and which may be readily and economically installed on existing entryway doors.

These object are accomplished with a door lock set, for use with an entry door to an enclosure, which includes a stem which passes transversely through the door to actuate the door latch, wherein the stem encloses a key lock mechanism and includes a key slot face at its outer end. A translucent doorknob has a central bore to be received over the stem, with the keyslot face being framed by the translucent knob. The knob is rotatably secured to the stem. The knob has at least one cavity opening to its inner face; and an electrically powered illuminating device is disposed within that cavity to project light to the front face of the knob. Electric conductors are connected to the illuminating device and pass out of the knob cavity for connection to a source of electric energy.

These objects are also accomplished in a method for illuminating a doorknob lock set which includes the following steps. The existing exterior knob is removed from the stem which extends transversely through the door. A knob is formed from translucent material, with a central door to receive the stem. At least one recess is formed in the knob opening to its interior face; and an electric powered luminating device is mounted within this recess. Electric conductors are connected to the illuminating device to pass from that device out of the knob recess. The translucent knob is mounted on the stem to frame the key slot at its outer end.

The novel features and the advantages of the invention, as well as additional object thereof, will be understood more fully from the following description when read in connection with the accompanying drawings.

DRAWINGS

DESCRIPTION OF THE PREFERRED EMBODIMENTS

Figure 1:
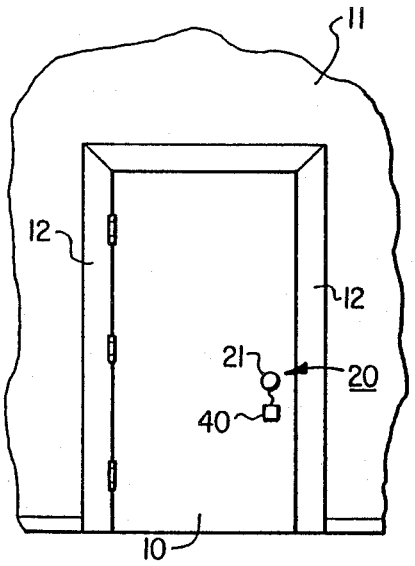
FIG. 1 is an elevation view of the exterior face of an entry door to a building.

FIG. 1 of the drawing illustrates a typical entry door 10 for a building enclosure 11, with the door being framed by molding members 12. The door is latched and locked by a conventional door lock set 20, including as exterior doorknob 21.

Figure 3:
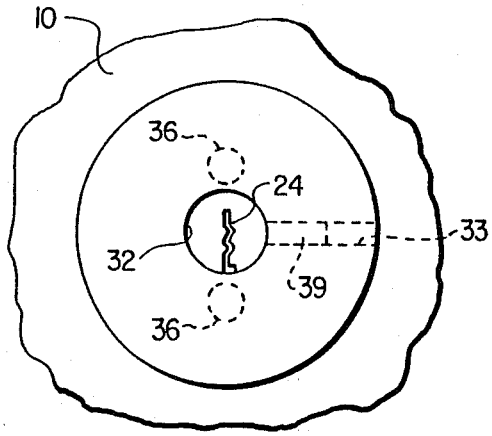
FIG. 3 is an exterior face view of the doorknob of FIG. 2.
Figure 2:
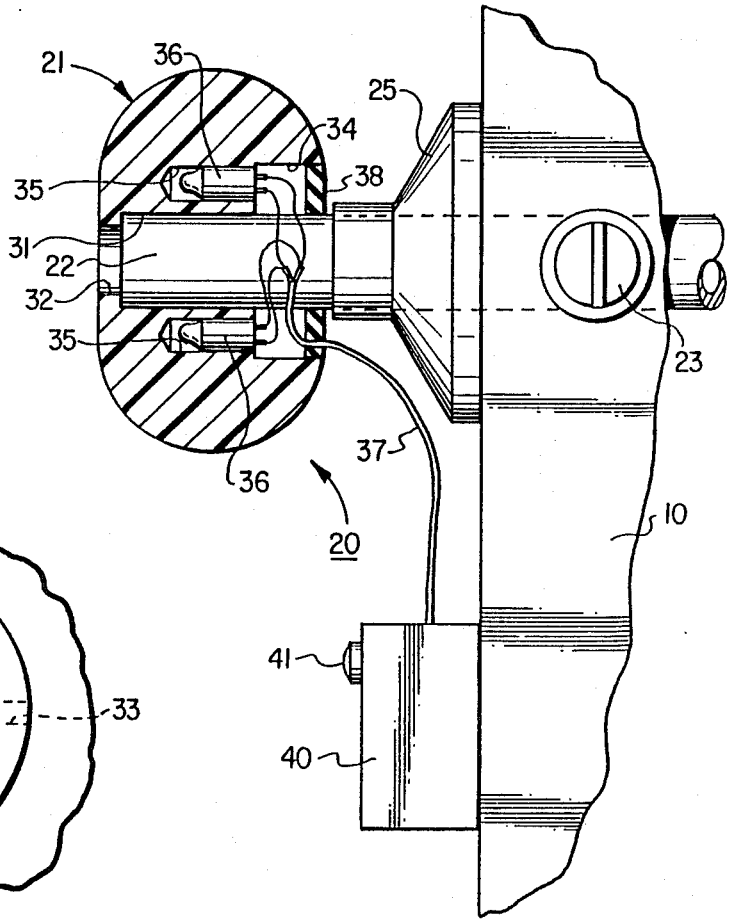
FIG. 2 is a fragmentary edge view of the door of FIG. 1, including an illuminated doorknob lock according to the invention.

The doorknob set is conventional; and certain of its components are particularly illustrated in FIGS. 2 and 3. The doorknob set includes an elongated stem 22 which extends transversely through a suitable transverse hole in the door, and which is rotatable about its longitudinal axis to operate the door latch pin 23. This stem encloses a key lock mechanism which is operated by inserting a key into a key slot 24 provided in the exterior end face of the stem 22. An escutcheon 25 surrounds the stem at the door face.

The doorknob 21 is fabricated from a plastic material, such as Lucite, which may be transparent, but which is at least translucent to permit the passage of light. The knob is provided with a central bore 31; and this bore may have a slightly reduced diameter portion 32 at its outer end to frame the reduced diameter outer tip of the stem 22 which includes the key slot. The knob is secured to the stem in any suitable manner, such as by a set screw 39 received in a transverse threaded bore 33 as illustrated in FIG. 3. The knob is formed with an enlarged counterbore 34 at its rearward face; and from this bore are formed two recesses or cavities 35 which extend from the face of the counterbore directionally toward the outer face of the knob. Electric illuminating devices such as incandescent bulbs 36 are mounted within these cavities in any suitable manner with their terminals exposed to the counterbore 34. A suitable multi-conductor cable 37 is connected to the terminals of the incandescent bulbs and passes from the counterbore 34 for connection to a suitable source of electric energy. A suitable insulating and sealing plug 38 is preferably inserted within the counterbore to seal the annular space between the counterbore and the stem 22.

FIGS. 1 and 2 illustrate one preferred form of an electric energy source for the illuminating device 36; which consists of a battery pack 40 which may include an integral pushbutton switch 41. This battery pack may consist of a case having means for convenient mounting on a door, with a cavity for receiving one or more suitable drycell batteries and associated circuitry for connecting the batteries through the switch 41 to terminals to which the cable 37 may be attached.

In one form of the invention, this battery pack 40 is conveniently mounted on the door below the doorknob 21, so that the switch 41 may be very easily operated to illuminate the doorknob and facilitate the key insertion.

A pushbutton switch 41 may be desirable where the property owner does not wish the doorknob to be illuminated continuously, but only when needed. Alternatively, the switch 41 may be a toggle switch; and this will enable leaving the doorknob lighted for persons who may not be familiar with the property. Where it is desired that the doorknob be illuminated at all time, the switch 41 may be eliminated. A photocell may be utilized for automatic continuous nighttime illumination.

The provision of two illuminating devices 36 is a convenience so that, should one of the devices fail, the illumination from one device will still be partially effective. The failed illuminating device may then be replaced.

Figure 4:
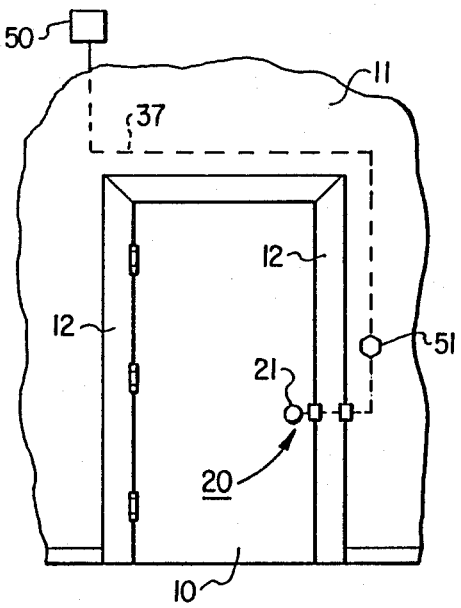
FIG. 4 is an elevation view of the exterior face of an entry door, illustrating an alternative form of the invention.

FIG. 4 of the drawing illustrates an alternative arrangement for providing electrical energy to the door lock set 20. In this arrangement, the source of electrical energy may be a transformer 50 located, for example, in the attic of the structure 11, and powered from the wiring system for the structure. The transformer may be the same transformer which powers a doorbell system provided for the entry door 10. For this arrangement the conductor cable 37 may pass through the interior of the door for example, or possibly be hidden by the door molding, and would be formed to bridge the joint between the door 10 and the door framing 12. The cable would then be mounted in any suitable manner to extend to the transformer 50. The illuminating device 36 may be connected in this manner for continuous illuminating. Alternatively an exterior switch 51, such as a toggle type switch, might be mounted adjacent to the door framing to illuminate the doorknob 21 when desired.

A new or existing doorknob lock set may be modified to provide an illuminated doorknob lock set by performing the following steps. The existing exterior doorknob is removed from the stem 22. A doorknob 21 of transparent or translucent material with a central bore 31 is provided possibly having a reduced diameter face bore 32 to be received over the outer end of the stem 22. The doorknob is further provided with an enlarged counterbore 34 at its inner face. At least one cavity 35 is formed from the face of that counterbore extending toward the outer face of the doorknob. An illuminating device 36 is placed within that cavity and secured therein in any suitable manner. Electrical conductors are connected to the terminals of that illuminating device to pass from the counterbore 34 for connection to an energy source. The counterbore may be plugged with a suitable plug member 38 to seal the interior of the doorknob from the elements. The conductors 37 are connected to a suitable electric energy source such as a battery power pack or a transformer.

What has been described is a unique method and apparatus for effecting the illumination of the exterior doorknob of an entry door, to facilitate the unlocking of that entry door when the door is approached in darkness.

A particular feature and advantage of the invention is that a doorknob is provided which can be substituted for an existing doorknob of a doorknob lock set, which doorknob is translucent to light, and which doorknob is readily configured to include illuminating devices which readily locate the key slot of the doorknob lock set.

Another feature and advantage of the invention is that the illuminating devices within the translucent doorknob may be powered readily from a battery pack conveniently mounted on the door, to enable either continuous or selective lighting for the doorknob.

While the preferred embodiments of the invention have been illustrated and described, it will be understood by those skilled in the at that changes and modifications may be resorted to without departing from the spirit and scope of the invention.

What is claimed:

1. For use with an entry door to an enclosure, the combination including:

a door lock set including a rotatable stem adapted to pass through the door to actuate the door latch, said stem enclosing a key lock mechanism and including a key slot face at the outer end thereof;

a doorknob of light conducting composition having a central bore to be received over said stem, with said key slot face being framed through the front outer face of said knob;

means for securing said knob in a surrounding relation to said stem;

said knob having a least one internal cavity extending about the stem therein and having an access opening facing toward the inner rear face thereof;

an electric powered illuminating device disposed within said cavity, to project light to the front face of said knob; and electric conductor means connected to said illuminating device and passing out of said knob cavity for connection to a source of electric energy.

2. The combination set forth in claim 1 including:

a battery pack unit adapted to be mounted on a door adjacent to said door lock set for connection to said conductor means for providing electric energy to said illuminating device.

3. The combination as set forth in claim 2 including:

a switch associated with said battery pack for selectively supplying and interrupting electric energy to said conductors.

4. A method for illuminating a doorknob lock set which includes a rotatable stem extending transversely through the door and containing a keyslot at its exterior end, including the steps:

removing an existing exterior knob from a rotational interlock relation with the stem;

providing a replacement doorknob of light conducting composition with a central bore to receive said stem and to enable said rotational interlock relation therewith to be effected;

forming at least one cavity in said replacement doorknob opening from the interior face thereof and extending toward the exterior face thereof;

mounting an electric powered illuminated device within said cavity;

securing electric conductors to said illuminating device to extend from said cavity for connection to a source of electric energy; and mounting said replacement doorknob in said rotational interlock relation on said stem to frame the keyslot at the exterior end of said stem

* * * * *